United States Patent [19]

Nakagawa et al.

[11] 4,268,725

[45] May 19, 1981

[54] ELECTRET MICROPHONE

[75] Inventors: Sadayoshi Nakagawa; Mitsuharu Shinohara, both of Fukuoka, Japan

[73] Assignee: Hosiden Electronics Co., Ltd., Osaka, Japan

[21] Appl. No.: 66,722

[22] Filed: Aug. 15, 1979

[30] Foreign Application Priority Data

Aug. 21, 1978 [JP] Japan ..... 53-114913[U]
Oct. 2, 1978 [JP] Japan ..... 53-135641[U]

[51] Int. Cl.[3] ..... H04R 19/04
[52] U.S. Cl. ..... 179/111 E; 179/110 A
[58] Field of Search ..... 179/111 E, 111 R, 121 R, 179/121 D, 110 R, 110 A, 110 B, 110 C, 110 D, 110 E, 110 F, 107 R, 107 E, 107 FD, 107 BC, 107 H, 107 S, 179

[56] References Cited

U.S. PATENT DOCUMENTS

Re. 28,420 5/1975 Murphy ..... 179/111 E
4,063,049 12/1977 Pipitone et al. ..... 179/110 A
4,081,628 3/1978 Neusel ..... 179/110 A

FOREIGN PATENT DOCUMENTS 2906497 8/1979 Fed. Rep. of Germany ... 179/111 E

*Primary Examiner*—Thomas A. Robinson
*Attorney, Agent, or Firm*—Pollock, Vande Sande & Priddy

[57] ABSTRACT

An electret microphone in which an electret diaphragm, a back electrode plate disposed opposite thereto and a tubular back electrode holder for holding the back electrode plate are housed in a capsule, an impedance conversion element is housed in a hole made in the peripheral wall of the back electrode holder, and an input terminal of the impedance conversion element is connected to the back electrode plate and an output terminal is led out of the capsule through a notch formed in its peripheral wall.

9 Claims, 7 Drawing Figures

ELECTRET MICROPHONE

BACKGROUND OF THE INVENTION

This invention relates to a condenser microphone employing an electret as a diaphragm, and relates more particularly to an electret microphone which is reduced in size in a direction perpendicular to the diaphragm.

In condenser microphones an impedance converter is housed in the microphone capsule so as to provide decreased output impedance, and in conventional electret microphones the impedance converter is disposed behind a back electrode plate. This severely limits the ability to reduce the size of the microphone in a direction perpendicular to the diaphragm. Accordingly, in order to effect miniaturization of the microphone, efforts have been made to reduce the radial dimension of the diaphragm; however, reducing the diameter of the diaphragm results in deteriorated tone quality and lowered sensitivity. The prior art microphone is thus comparatively thick and hence is not suitable for use, for example, as an attachment to a tiepin, because it greatly protrudes from a necktie. Further, when a nondirectional microphone of the prior art type is attached to a tiepin, sounds are muffled in the microphone to provide degraded articulation and while this makes the microphone unidirectional, the microphone, due to its thick configuration, nevertheless catches surrounding noises.

An object of this invention is to provide a thin electret microphone.

Another object of this invention is to provide a miniature electret microphone which is excellent in tone quality and high in sensitivity.

Another object of this invention is to provide a thin, unidirectional electret microphone.

SUMMARY OF THE INVENTION

In accordance with this invention, an electret diaphragm is disposed in a capsule, and a back electrode plate is placed in opposing relation to the diaphragm. The back electrode plate is supported by a ring-shaped back electrode holder, and an impedance conversion element is disposed in a slot formed in the outer side wall of the back electrode holder. The impedance conversion element has its input terminal connected to the back electrode plate and its output terminal is led to the outside of the capsule through a hole made in the capsule. Since the impedance conversion element is housed in the slot formed in the side wall of the back electrode holder, the microphone of the present invention can be made thin. When it is desired to make the microphone unidirectional, the back of the back electrode holder is covered with a shield plate having sound holes therein, and a damper cloth inserted in the space defined between the shield plate and the back electrode plate.

DESCRIPTION OF THE PREFERRED EMBODIMENTS

Figure 1:
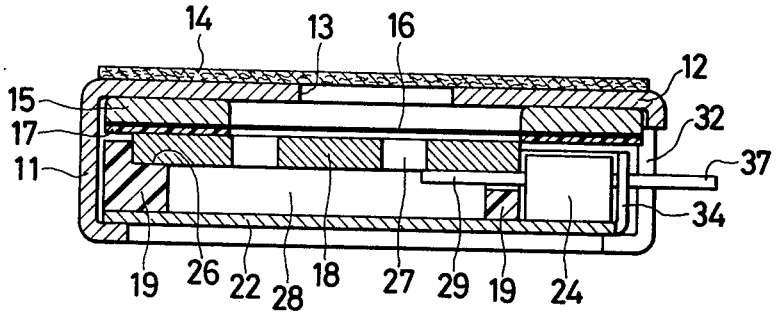
FIG. 1 is a cross-sectional view showing an example of an electret microphone constructed in accordance with the present invention.

In FIG. 1, reference numeral 11 identifies a capsule, which is a cylindrical member made, for example, of aluminum or like metal as is the case in the prior art. One end face of the capsule 11 is entirely covered by a front plate 12 having a centrally disposed hole 13 for introducing into the capsule 11 sounds from the front of the microphone, and a dust proof cloth 14 is adhesively attached to the front plate 12 to cover the central hole 13.

In the capsule 11 there is disposed a diaphragm 16 which is mounted on a ring 15 that is in contact with the front plate 12. The diaphragm 16 comprises a polarized dielectric film which is deposited on a metallic foil all over one surface on the side of the ring 15. A back electrode plate 18 is placed in opposing relation to the diaphragm 16 with a ring-shaped spacer 17 interposed therebetween, the spacer 17 being held in contact with the marginal portion of the diaphragm 16. The back electrode plate 18 is supported by a back electrode holder 19. The rear end of the capsule 11 is covered by a shield plate 22 at the rear of the back electrode holder 19, and the side walls of the capsule at the rear end of the capsule 11 are bent inwardly in overlapping reaction to the plate 22, as shown, to stake the plate 22 to the back of the holder 19. As a result of this arrangement, the diaphragm 16, the back electrode plate 18, the back electrode holder 19 and the shield plate 22 are mechanically fixed in the capsule 11.

Figure 2:
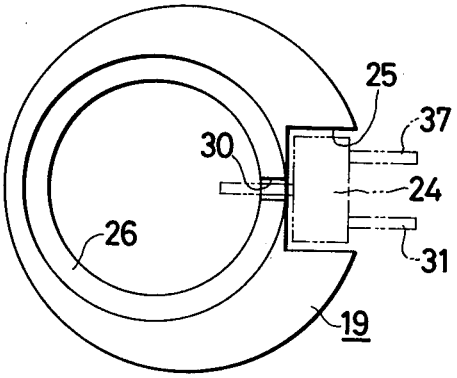
FIG. 2 is a plan view of the back electrode holder 19 utilized in the microphone of FIG. 1.
Figure 3:
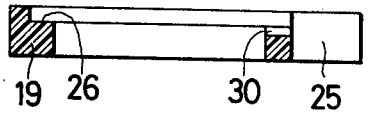
FIG. 3 is a cross-sectional view of the back electrode shown in FIG. 2.

In the present invention, and impedance conversion element 24 is housed in the peripheral wall of the back electrode holder 19. For example, as shown in FIGS. 2 and 3, the back electrode holder 19 is a relatively thick ring-shaped member fabricated of a synthetic resin, and the holder 19 has slot 25 formed in its outer side wall for receiving the impedance cnversion element 24. In FIG. 2, the inner periphery of the ring-shaped back electrode holder 19 is eccentric with respect to the outer periphery of holder 19 so that the portion of the side wall of holder 19 in which the slot 25 is formed is thicker than the wall portion diametrically opposite thereto. The inner face of the back electrode holder 19 has formed therein a ring-shaped stepped portion 26 on the side of the diaphragm 16, and the back electrode plate 18 is snugly fitted into the stepped portion 26. The back electrode plate 18 has formed therein ventilating holes 27, which permit intercommunication of a rear compartment 28 defined between the back electrode 18 and the shield plate 22 with the space between the back electrode plate 18 and the diaphragm 16.

Figure 4:
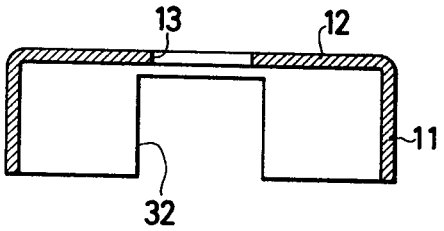
FIG. 4 is a cross-sectional view of the capsule 11 used in the microphone of FIG. 1.

The impedance conversion element 24 operates to convert a high impedance signal into a low impedance one and usually takes the form of a circuit which is composed of a field effect transistor and a resistance element fabricated as a integrated circuit; the impedance conversion element 24 may be the same as that heretofore employed in this kind of microphone. An input terminal 29 of the impedance conversion element 24 is connected, as by spot welding, to the underside of the back electrode plate 18. The slot 25 is formed to partly extend to the stepped portion 26, so that the slot 25 communicates with the inside of the back electrode holder 19 at the stepped portion 26, where the input terminal 29 is led to the inside of the back electrode holder 19 along the back electrode plate 18. The stepped portion 26 has formed therein a groove 30 for receiving one part of the input terminal 29. In practice, the back electrode plate 18 is placed on the holder 19, with the impedance conversion element 24 connected to the back electrode plate 18, and the impedance conversion element 24 is placed in the slot 25. An output terminal 31 of the impedance conversion element 24 is led out of the capsule 11, without touching it, through a notch 32 formed in the side wall of the capsule 11 in opposing relation to the slot 25. Such a notch 32 is shown in FIG. 4 and extends from the rear end of the capsule 11 to the vicinity of the front plate 12. An adhesive material is packed into the slot 25 to fix therein the impedance conversion element 24 and to prevent air in the rear compartment 28 from escaping through the slot 25.

Figure 5:
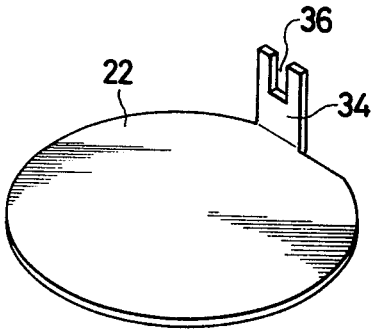
FIG. 5 is a perspective view of the shield plate 22 utilized in the microphone of FIG. 1.

The shield plate 22 has a lug 34 formed integrally therewith to extend from one portion of its marginal edge substantially at right angles, as shown in FIG. 5. The lug 34 is inserted between the impedance conversion element 24 and the capsule 11. For interconnecting the shield plate 22 and a ground terminal 37 of the impedance conversion element 24, the lug 34 is provided with a narrow notch 36 which extends downwardly from its upper end, and the ground terminal 37 is pressed into the notch 36. The lug 34 and the output terminal 31 of the impedance conversion element 24 are spaced apart so as not to make contact with each other.

In the conventional electret microphone, since the impedance conversion element 24 is placed in the rear compartment 28, there is a limit to how much size of the microphone can be reduced in a direction perpendicular to the diaphragm 16. In the electret microphone of this invention, however, the impedance conversion element 24 is housed in the side wall of the back electrode holder 19, so that the microphone can be reduced in size in the direction perpendicular to the diaphragm 16; namely the thickness of the microphone can be reduced by a dimension corresponding to the thickness of the impedance conversion element 24. As compared with a conventional electret microphone of equal bulk, therefore, the microphone of this invention is significantly smaller in thickness and the diameter of the diaphragm 16 is increased, whereby the microphone of the present invention provides excellent tone quality and stable sensitivity. Since the diameter of the diaphragm 16 is large, there is no particular need to make the spacer 17 thinner for enhancement of sensitivity, and the sensitivity becomes very stable and high; furthermore the various parts of the microphone need not be produced to tightly restricted dimensional tolerances and hence are easy to fabricate and assemble. Moreover, the present invention meets a recent demand for thin microphones which have a small length in the axial direction of the microphone capsule. The microphone of this invention is to thin that, for example, when attached to a tiepin, it does not greatly protrude and hence is neither a nuisance nor unsightly.

Figure 6:
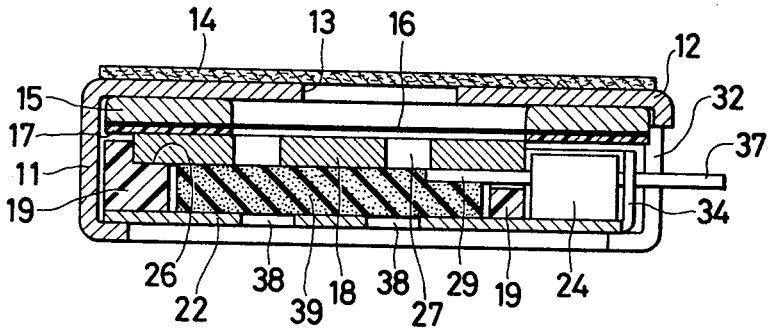
FIG. 6 is a cross-sectional view illustrating an example of a unidirectional electret microphone constructed in accordance with the present invention.

The directivity of the abovesaid microphone can be made unidirectional by an arrangement of the type shown, for example, in FIG. 6, in which parts corresponding to those in FIG. 1 are identical by the same reference numerals. The arrangement of FIG. 6 is identical with that of FIG. 1 except that the shield plate 22 has formed therein, for example, a plurality of sound holes 38 to permit the communication therethrough of the rear compartment 28 with the outside, and a damper cloth 39 is inserted in the rear compartment 28. When the damper cloth 39 is relatively thin, it may also be adhesively attached to the shield plate 22 in a manner to cover the sound holes 38. The damper cloth 39 may be non-woven fabric, porous urethane of excellent air-permeability, loosely woven, air-permeable felt or the like.

With an arrangement of the type depicted in FIG. 6, sounds reach the diaphragm 16 through the central hole 13 from the front of the microphone, and through the sound holes 38 and the ventilating holes 27 from the rear of the microphone. The sounds entering the microphone from the rear of the microphone are damped by the damper cloth 39 down to a suitable magnitude, thereby to provide the desired unidirectionality. In a thin microphone having a large-diameter diaphragm, the level of the low sound range does not drop and sounds are muffled in the microphone, resulting in degraded articulation in some cases; but a unidirectional microphone is free frm such a defect. Further, when used, for example, as an attachment to a tiepin, the unidirectional microphone of the present invention hardly catches surrounding sounds due to its unidirectionality and thin configuration.

Figure 7:
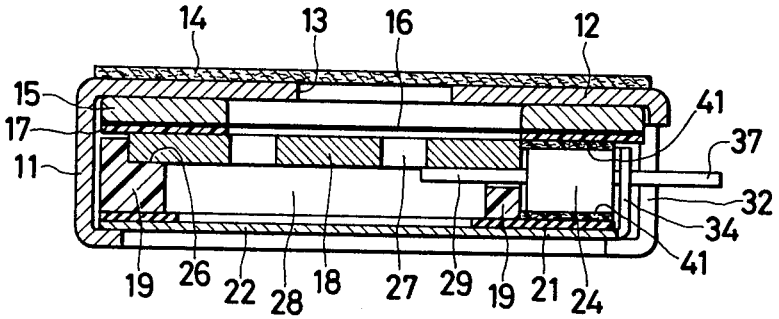
FIG. 7 is a cross-sectional view of a modified form of the electret microphone of the present invention.

As illustrated in the modified form of the invention shown in FIG. 7 in which parts corresponding to those in FIG. 1 are identified by the same reference numerals, the air pressure in the capsule 11 can be kept equal to the outside air pressure at all times by interposing between the back electrode holder 19 and the shield plate 22 a ring-shaped cushion 21 which is air-permeable to an extent such as not to produce an acoustic influence. If the cushion 21 is made of an elastic material, then the capsule 11 and the shield plate 22 elastically contact one another so that, when the capsule 11 is staked, the internal structure is held stable. It is also possible to use a cushion which is not air-permeable but elastic, in which case the interior surface of the shield plate 22 is roughened to permit an air flow between the inside of the capsule 11 and the outside. Also it is possible to wrap the impedance conversion element 24 in an elastic sheet 41 such as, for example, a rubber sheet, and to fit the wrapped element 24 in the slot 25, thereby to prevent air leakage from the rear compartment 28 through the slot 25.

In a specific embodiment of the present invention which achieved excellent unidirectionality, the capsule 11 was about 9.5 mm in diameter and about 2.5 mm in thickness, the back electrode holder 19 was about 1.2 mm in length, the slot 25 was 3.2 in width and four holes 0.8 mm in diameter were formed as the sound holes 38.

It will be apparent that many modifications and variations may be effected without departing from the scope of the novel concepts of this invention.

What is claimed is:

1. An electret microphone comprising:

a cylindrical capsule having a front plate which is provided with an aperture for introducing sound into the capsule;

an electret diaphragm disposed in the capsule adjacent to and in opposing relation to said front plate;

a back electrode plate in said capsule disposed adjacent to said diaphragm in opposing relation thereto;

a ring-shaped back electrode holder disposed in the capsule coaxially therewith for holding the back electrode plate in place;

a side wall of said ring-shaped back electrode holder being provided with a slot which faces towards the inner peripheral surface of the capsule; and an impedance conversion element disposed in said slot, said impedance conversion element having an input terminal which is connected to the back electrode plate and an output terminal which is led out of the capsule through an opening in the side wall of the capsule.

2. An electret microphone according to claim 1, wherein said back electrode holder has an inner ring-shaped periphery which is eccentric with respect to the outer ring-shaped periphery of said holder so that the portion of the side wall of said holder in which said slot is formed is thicker than the wall portion of said holder diametrically opposite thereto.

3. An electret microphone according to claim 1, wherein a ring-shaped stepped portion is formed in the surface of said back electrode holder which faces said diaphragm, said back electrode plate being in engagement with said ring-shaped stepped portion and being held in place by the back electrode holder, means defining a reduced bore which extends from said slot to said ring-shaped stepped portion for effecting communication between said slot and the inside of the back electrode holder, the input terminal of said impedance conversion element being led to the inside of the back electrode holder through said reduced bore.

4. An electret microphone according to claim 3, wherein the input terminal of the impedance conversion element is led to the inside of the back electrode holder along the back of the back electrode plate.

5. An electret microphone according to claim 3, wherein said reduced bore comprises a groove formed in the ring-shaped stepped portion for receiving one part of the input terminal of the impedance conversion element.

6. An electret microphone according to claim 1, wherein a shield plate is disposed behind the back electrode holder to cover it, and wherein the rear end portion of the capsule is bent to be urged against the back of the shield plate.

7. An electret microphone according to claim 6, wherein said shield plate has a lug formed integrally therewith to extend from one portion of its marginal edge at right angles, the lug being inserted between the impedance conversion element and the inner peripheral surface of the capsule, a grooved terminal of the impedance conversion element being connected to the lug.

8. An electret microphone according to claim 7, wherein a notch is formed in the lug to extend down from its upper end for receiving the ground terminal of the impedance conversion element.

9. An electret microphone according to claim 6, wherein the shield plate has formed therein sound holes for introducing sounds into the capsule from behind, and wherein a damper cloth is disposed between the shield plate and the back electrode plate.

* * * * *